United States Patent [19]

Forney, Jr. et al.

[11] Patent Number: 4,502,749

[45] Date of Patent: Mar. 5, 1985

[54] COAXIAL CONNECTOR FOR MICROWAVE PACKAGES

[75] Inventors: Edgar W. Forney, Jr., Harrisburg; Richard S. Hogendobler, Camp Hill, both of Pa.

[73] Assignee: AMP Incorporated, Harrisburg, Pa.

[21] Appl. No.: 557,019

[22] Filed: Dec. 1, 1983

[51] Int. Cl.[3] ..... H01R 17/18

[52] U.S. Cl. ..... 339/177 R; 339/219 R; 339/258 R

[58] Field of Search ..... 339/177, 217 R, 219 R

[56] References Cited

U.S. PATENT DOCUMENTS

| | | | |
|---|---|---|---|
| 1,624,595 | 4/1927 | Haddock | 339/219 R |
| 2,025,189 | 12/1935 | Yanchenko | 339/219 R |
| 3,292,136 | 12/1966 | Somerset | 339/177 E |
| 3,354,420 | 11/1967 | Minick | 339/177 R |
| 3,673,546 | 6/1972 | Green et al. | 339/177 R |
| 3,784,964 | 1/1974 | Newman et al. | 339/219 R |
| 4,035,045 | 7/1977 | Trevithick | 339/219 R |

*Primary Examiner*—John McQuade
*Assistant Examiner*—David L. Pirlot
*Attorney, Agent, or Firm*—Adrian J. LaRue

[57] ABSTRACT

A coaxial connector for electrical connection to a microwave package comprises an outer metal body member having a dielectric-receiving bore extending therethrough which has an inner section and an outer section, the diameter of the inner section being smaller than the diameter of the outer section thereby defining a shoulder therebetween. A dielectric member of substantially the same diameter as that of the inner section disposed along the dielectric-receiving bore and having a contact-receiving bore extending therethrough along which a center contact member is disposed. Aligned holes extending through the dielectric member and the center contact member in which a dielectric securing member is disposed. Ends of the securing member extend slightly beyond the outside surface of the dielectric member in engagement with the shoulder, and a securing ring member tightly disposed between the outer surface of the dielectric member and the outer section of the dielectric-receiving bore and in engagement with the ends of the securing member thereby securing the dielectric member and center contact member in the outer metal body member.

8 Claims, 6 Drawing Figures

COAXIAL CONNECTOR FOR MICROWAVE PACKAGES

FIELD OF THE INVENTION

This invention relates to electrical connectors and more particularly to coaxial connectors for microwave packages.

BACKGROUND OF THE INVENTION

Coaxial connectors in current use for microwave packages have a hole extending through the outer metal body member which is aligned with a hole extending through a dielectric member in a bore of which a center contact is disposed. An annular recess of the center contact is coincident with the hole in the dielectric member. An epoxy resin is poured into the aligned holes and it fills the annular recess of the center contact. After the epoxy resin cures, it locks the body member, dielectric member and center contact together as a coaxial connector which can then be electrically connected to a microwave package.

Under thermal shock, the epoxy resin can form cracks thereby resulting in RF leakage because of the holes in the outer metal body member. The aligning of the holes in the body member and the dielectric member is difficult. Making certain the flat contact section of the center contact for electrical connection to the conductive impedance path of the microwave package is in proper orientation is also difficult. The center contact does not have a closed entry which can result in damage to the center contact causing improper electrical connection requiring replacing the connector or discarding the microwave package.

SUMMARY OF THE INVENTION

According to the present invention, a coaxial connector for electrical connection to a microwave package comprises an outer metal body member, having a dielectric-receiving bore extending therethrough, which has an inner section and an outer section. The diameter of the inner section is smaller than the diameter of the outer section thereby defining a shoulder therebetween. A dielectric member of substantially the same diameter as that of the inner section disposed along the dielectric-receiving bore and having a contact-receiving bore extending therethrough along which a center contact member is disposed. Aligned holes extending through the dielectric member and the center contact member in which a dielectric securing member is disposed. Ends of the securing member extend slightly beyond the outside surface of the dielectric member in engagement with the shoulder, and a securing ring member tightly disposed between the outer surface of the dielectric member and the outer section of the dielectric-receiving bore and in engagement with the ends of the securing member thereby securing the dielectric member and center contact member in the outer metal body member.

DETAILED DESCRIPTION OF THE INVENTION

Figure 1:
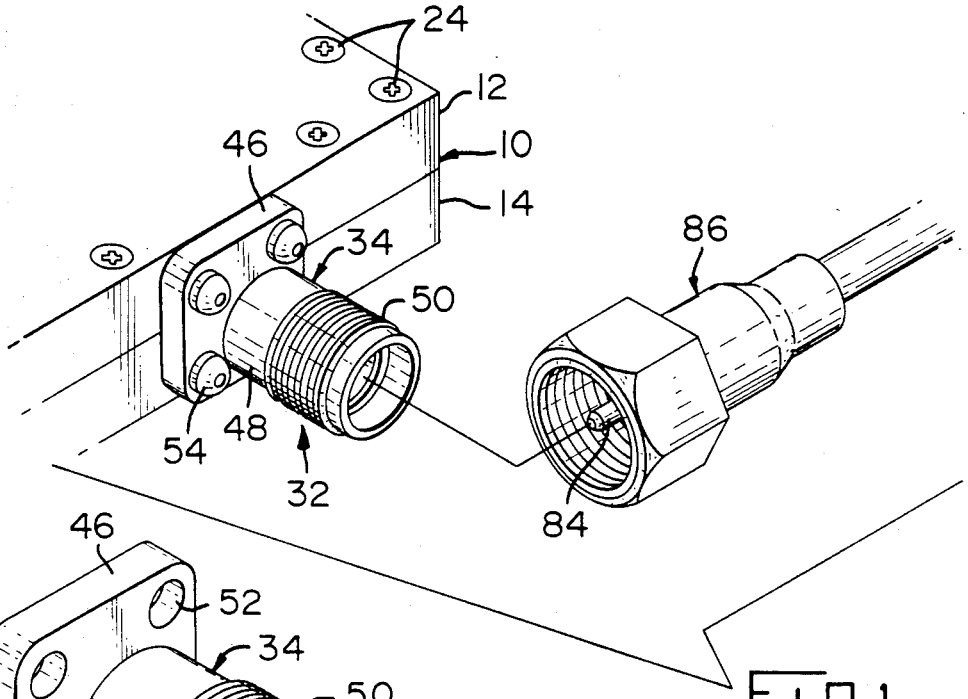
FIG. 1 is a part perspective view of a microwave package on which a coaxial connector is mounted and a matable coaxial connector exploded therefrom.
Figure 2:
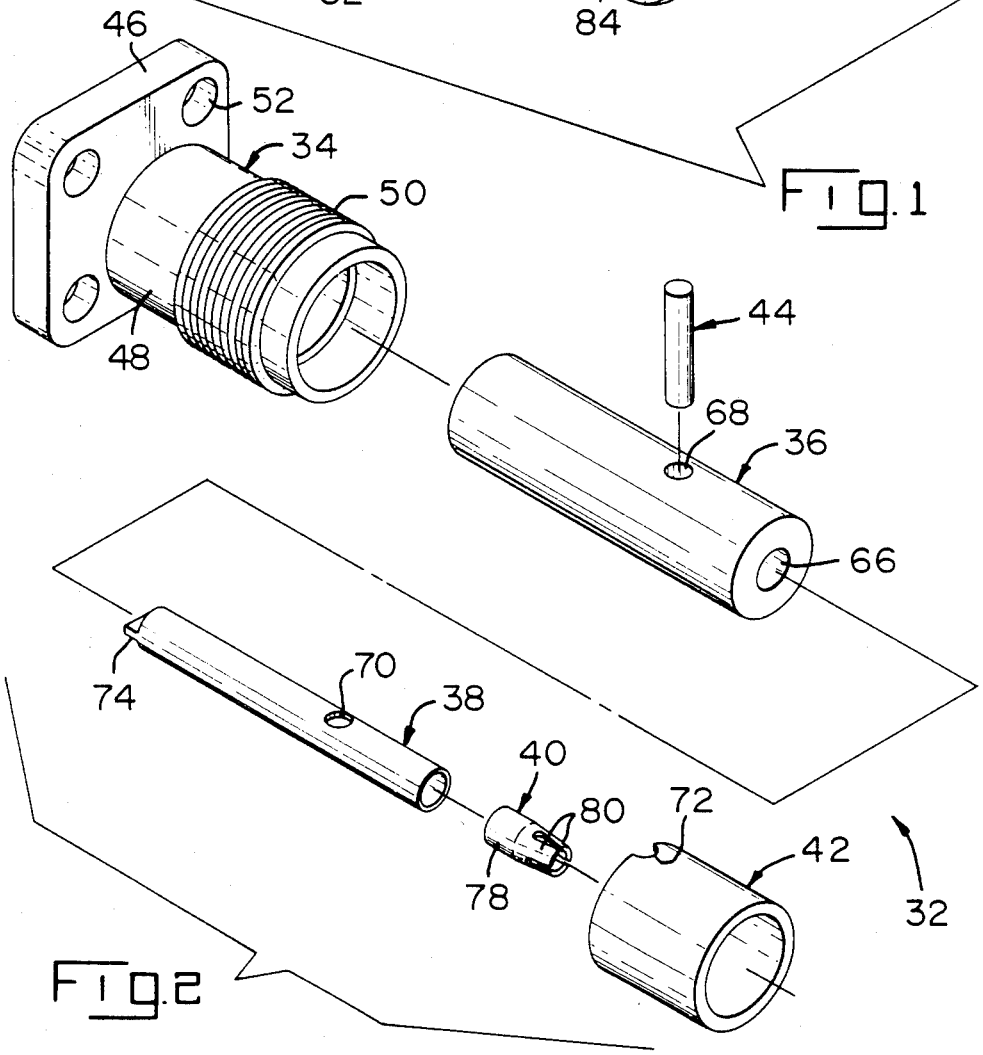
FIG. 2 is an exploded perspective view of the parts of the coaxial connector of the present invention.
Figure 3:
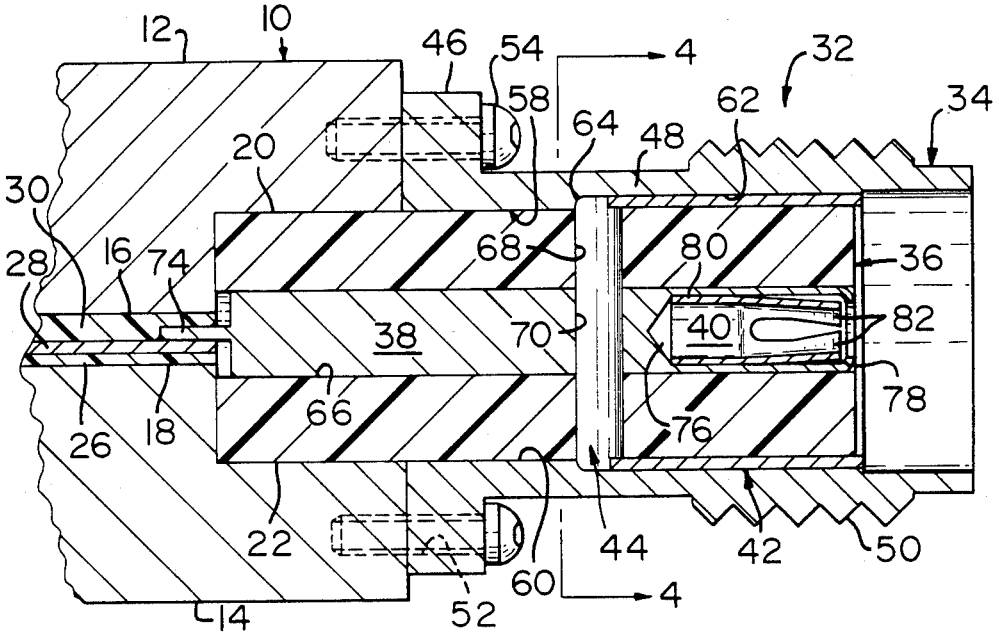
FIG. 3 is a cross-sectional view of the connector of FIG. 2 in an assembled condition.
Figure 4:
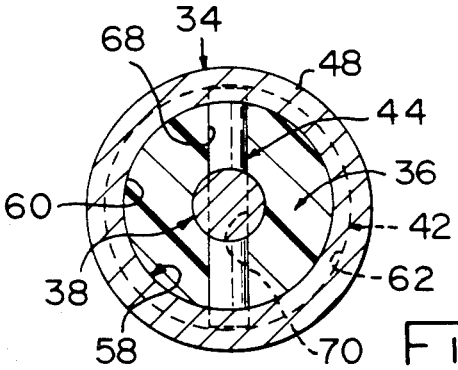
FIG. 4 is a cross-sectional view taken along line 4—4 of FIG. 3.

FIGS. 1 and 3 illustrate a microwave package 10 which can be either of the strip line or microstrip type. Microwave package 10 includes metal housing members 12 and 14 which have cavities 16 and 18 that are in communication with arcuate cavities 20 and 22 at one end of housing members 12 and 14. Screws 24 secure housing members 12 and 14 together.

A dielectric substrate 26 which is made from a suitable dielectric material of typically reinforced Teflon material is disposed in cavity 18 and has a conductive path 28 thereon of specified impedance. A similar dielectric substrate 30 disposed in cavity 16 and covers dielectric substrate 26 and conductive path 28 thereon.

Coaxial connector 32 is mounted on microwave package 10 and is electrically connected thereto. Coaxial connector 32 as shown in FIGS. 1 through 4 includes an outer metal body member 34, a dielectric member 36, a center metal contact member 38 including a spring contact member 40, a metal securing ring member 42, and a dielectric securing pin 44.

Outer metal body member 34 includes a mounting flange 46 and a tubular section 48 on which threads 50 are located. Mounting flange 46 has holes 52 through which screws 54 extend into threadable engagement with threaded holes 56 in housing members 12 and 14 to secure coaxial connector 32 to microwave package 10 and to electrically connect it thereto. A dielectric-receiving bore 58 extends through mounting flange 46 and tubular section 48 and includes an inner section 60 and an outer section 62; inner section 60 has a smaller diameter than outer section 62 so that a shoulder 64 is located at the junction therebetween.

Dielectric member 36 is molded or machined from a suitable material having the desired dielectric characteristics and has a contact-receiving bore 66 extending therethrough in which center contact member 38 is disposed. The diameter of dielectric member 36 is such that it fits within dielectric-receiving bore 58 of body member 34 and has a diameter slightly less than inner section 60 of bore 58 and a part of dielectric member 36 extends beyond mounting flange 46 into the hole formed by arcuate cavities 20 and 22 in housing members 12 and 14 of microwave package 10 as shown in FIG. 3. A contact-receiving bore 66 extends through the dielectric member 36 in which center contact member 38 is disposed. Dielectric member 36 has a hole 68 extending therethrough in communication with bore 66 and center contact member 38 has a hole 70 extending therethrough which are aligned with one another when center contact member 38 is disposed in bore 66 of dielectric member 36 so that securing pin 44 is positioned in aligned holes 68 and 70 with the ends thereof extending slightly beyond the outer surface of dielectric member 36 and in engagement with shoulder 64 whereafter securing ring member 42 is positioned between outer section 62 of bore 58 and the outer surface of dielectric member 36 in a force-fitted manner with recesses 72 engaging the outer ends of securing pin 44 thereby pressing them against shoulder 64 to secure dielectric member 36 and center contact member 38 in position in body member 34 as shown in FIG. 3.

Securing pin 44 is made from a commercially-available epoxy glass material that is strong and stiff and effectively secures dielectric member 36 and center contact member 38 in position in body member 34. Thus, no holes are formed in body member 34 to insert securing pin 44 in position in aligned holes 68 and 70 thereby precluding any RF leakage therethrough.

Center contact member 38 has a flat contact section 74 that is disposed between dielectric substrate 30 and conductive path 28 with the outer section of dielectric member 36 disposed in cavities 20, 22 when housing members 12, 14 are assembled as shown in FIG. 3 so that when housing members 12 and 14 are tightly secured together by screws 24, an excellent mechanical and electrical connection with conductive path 28 takes place. Screws 54 also assure an excellent mechanical and electrical connection of body member 34 to housing members 12, 14. A bore 76 is located in the front end of center contact member 38 in which spring contact member 40 is disposed. The front end of center contact member 38 is rolled over to form a flange 78 thereby securing spring contact member 40 in position in bore 76.

Figure 5:
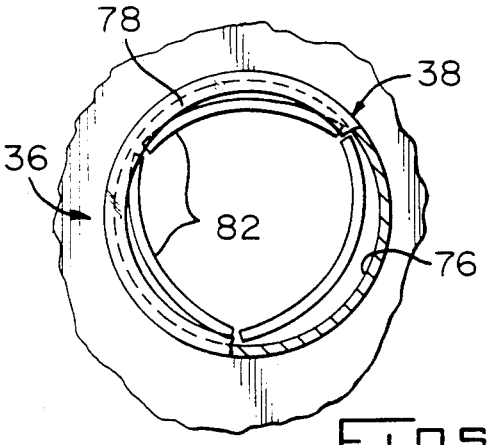
FIGS. 5 and 6 are part end views of the center contact member without and with electrical connection with a center contact member of a matable connector.
Figure 6:
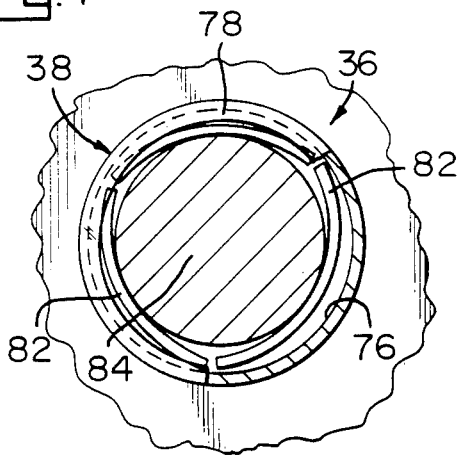

Spring contact member 40 is stamped and formed from a suitable metal having the desired spring characteristics and includes a cylindrical section 80 and inwardly-directed arcuate-shaped spring contact sections 82. The outer edges of the ends of spring contact sections 82 are disposed back of flange 78 while the remaining parts of the ends of spring contact sections 82 are closer to the axis of the connector than flange 78 as shown in FIGS. 5 and 6 which provides point contact of spring contact sections 82 with center contact member 38 thereby transmitting current to the outer surface of center contact member 38 in addition to protecting center contact member 38 from damage when pin section 84 of complementary matable coaxial connector 86 is matably connected with coaxial connector 32.

A coaxial connector has been disclosed which has no holes extending through its metal body member that could cause RF leakage to occur when high frequency signals are being transmitted therethrough, and the center contact member precludes any damage thereto when mating with a complementary coaxial connector.

What is claimed is:

1. A coaxial connector, comprising:

an outer metal body member having a dielectric receiving bore extending therethrough which has an inner section and an outer section, the diameter of the inner section being smaller than the diameter of the outer section thereby defining a shoulder therebetween;

a dielectric member of substantially the same diameter as that of the inner section disposed along the dielectric-receiving bore and having a contact-receiving bore extending therethrough, a hole extending through said dielectric member in communication with said contact-receiving bore;

a center contact member disposed along said contact-receiving bore and having another hole extending therethrough in alignment with the hole in said dielectric member;

a dielectric securing pin disposed in said holes and having free ends extending outwardly from an outer surface of said dielectric member in engagement with said shoulder; and a securing ring member disposed between said outer section and the outer surface of said dielectric member and in engagement with the free ends of said securing pin thereby securing said dielectric member and center contact in said body member.

2. A coaxial connector as set forth in claim 1, wherein said body member has a tubular section and a mounting flange.

3. A coaxial connector as set forth in claim 1, wherein said dielectric member has a section extending outwardly beyond an inner end of said body member.

4. A coaxial connector as set forth in claim 1, wherein said center contact member has a flat contact section extending outwardly from an inner end of said dielectric member.

5. A coaxial connector as set forth in claim 1, wherein the securing ring member has recesses in which the free ends of the securing pin are disposed.

6. A coaxial connector as set forth in claim 1, wherein said center contact member has a bore at an outer end, a spring contact member is disposed in said center contact bore, and a flange of said center contact secures said spring contact member in said center contact bore.

7. A coaxial connector as set forth in claim 6, wherein said spring contact member includes a cylindrical section and inwardly-directed, arcuate-shaped spring contact sections.

8. A coaxial connector as set forth in claim 7, wherein the outer edges of the ends of the spring contact sections are disposed in back of the flange where the remaining parts of the ends of the spring contact sections are closer to the axis of the connector than the flange.

* * * * *